US005302572A

United States Patent [19]

Anthonsen et al.

[11] Patent Number: 5,302,572

[45] Date of Patent: Apr. 12, 1994

[54] MULTILAYER IMAGE RECEIVING MATERIAL FOR THERMAL DYE TRANSFER AND PROCESS FOR PRODUCING SAME

[75] Inventors: Reiner Anthonsen, Bramsche; Wieland Sack, Bessendorf; Dieter Becker, Georgsmarienhutte; Jurgen Graumann, Wallenhorst; Manuela Hesse, Melle, all of Fed. Rep. of Germany

[73] Assignees: Felix Schoeller, Jr.; Papierfabrik GmbH & Co., AG, Osnabruck, Fed. Rep. of Germany

[21] Appl. No.: 877,992

[22] Filed: May 4, 1992

[30] Foreign Application Priority Data

May 24, 1991 [DE] Fed. Rep. of Germany ..... 4116994

[51] Int. Cl.[5] ..... B41M 5/035; B41M 5/38

[52] U.S. Cl. ..... 503/227; 427/146; 427/152; 427/299; 427/322; 427/385.5; 427/393.5; 428/195; 428/212; 428/500; 428/913; 428/914

[58] Field of Search ..... 8/471; 428/195, 913, 428/914, 212, 500; 503/227; 427/146, 152, 299, 322, 372.2, 385.2, 393.5

[56] References Cited

U.S. PATENT DOCUMENTS 4,837,200 6/1989 Kondo et al. ..... 503/227

FOREIGN PATENT DOCUMENTS 0409515 1/1991 European Pat. Off. ..... 503/227

4117317A1 12/1991 Fed. Rep. of Germany ..... 503/227

*Primary Examiner*—Bruce H. Hess

*Attorney, Agent, or Firm*—Lockwood, Alex, FitzGibbon & Cummings

[57] ABSTRACT

A process for producing and an image receiving material for dye diffusion thermal transfer processes comprises a carrier material, an intermediate layer of a crosslinked material, and an image receiving layer of an uncrosslinked material, and the two layers are produced without using organic solvents.

21 Claims, No Drawings

MULTILAYER IMAGE RECEIVING MATERIAL FOR THERMAL DYE TRANSFER AND PROCESS FOR PRODUCING SAME

BACKGROUND AND DESCRIPTION OF THE INVENTION

This invention relates to an image receiving material for thermal dye transfer processes in which the material has an intermediate layer and a dye receiving layer, and to a process for producing same.

Thermal dye transfer systems, e.g. dye diffusion thermal transfer D2T2, produce images of originals by an electronic method. The originals are broken down into the primary colors cyan, magenta and yellow plus optionally black, which are then converted to electric pulses, and the pulses are relayed to a thermal printer where they are converted to heat in the print head.

The image receiving material passes through the thermal printer in contact with an ink donor element. In the print head the reverse side of a dye donor element is heated in accordance with the pulses given and a dye is released that diffuses or sublimes into this receiving layer of the image receiving material. This process is repeated successively for all the colors, then yielding the finished image.

It is known from JP-OS 60-236794 that carrier materials made of paper can be coated with high molecular thermoplastic materials before applying the image receiving layer. These high molecular thermoplastics may be polyolefins, polystyrene, polyvinylidene chloride, polyethylene terephthalate, polymethyl methacrylate or ionomer resins. This intermediate layer of thermoplastics should even out the irregularities in the paper surface.

U.S. Pat. No. 4,774,224 also describes an image receiving material for dye diffusion thermal transfer with a paper backing that is provided with a thermoplastic intermediate layer, preferably comprising a polyolefin. According to this patent, the surface roughness of the intermediate layer should be limited to $<0.2$ μm (average peak-to-valley roughness 7.5 μinch).

European Patent No. 407 613 describes an image receiving material which also has thermoplastic intermediate layers. The thermoplastics are preferably polyolefins, polyvinyl chloride, polystyrene, polyethylene terephthalate, polymethacrylate or polycarbonate. The surface roughness of the intermediate layer is between 0.2 and 4.0 μm in this patent.

All three patent publications describe image receiving materials for dye diffusion thermal transfer having a thermoplastic intermediate layer between the paper backing material and the image receiving layer. The quantity of the image transferred is supposed to be improved by the intermediate thermoplastic layer.

However, the image receiving materials of these three aforementioned publications have a definite shortcoming in the finished image with regard to thermal stability and aging resistance. The definition is progressively reduced, lines are broadened and blurred, and the text may be blurred to the point of illegibility. However, the thermal stability and the heat resistance of the image receiving materials are important criteria for their use and for suitability for use.

Therefore, the goal of this invention is to provide an image receiving material for dye diffusion thermal transfer processes that will make it possible to produce images with a high color density that are resistant to aging and heat, and will thus largely retain their good image quality.

This problem is solved by an image receiving material with an intermediate layer of a crosslinked material and an image receiving layer of uncrosslinked material applied to it, whereby both layers are produced from coating compositions that are free of organic solvents.

It was surprising to discover that through the combination of these two layers, a high color density and an excellent thermal stability and aging resistance of the image could be achieved because these good results could not be achieved either through use of two uncrosslinked layers or two crosslinked layers.

The materials used for the intermediate layer are lacquers of monomers, oligomers or prepolymers, but usually mixtures of these groups. Mainly the monomers serve as diluents in the lacquers. The monomers can be omitted to advantage if the coating compositions are processed at elevated temperatures, preferably 300° C. to 60° C.

The monomers, oligomers and prepolymers contain carbon double bonds ($>C{=}C<$), as acryl, methacryl, allyl or vinyl compounds. They may also contain hydroxyl groups, carboxyl groups and other polar groups, e.g. to improve adhesion of the image receiving layer.

Preferably, the crosslinkable compounds should comprise more than 50 wt % acrylate esters and/or methacrylate esters.

The lacquers can be filled to advantage before crosslinking with white pigments, such as carbonates, oxides, sulfates or sulfites of the elements calcium, magnesium, barium, strontium, zinc or titanium. Because of its high refractive index, titanium dioxide has proven especially suitable. Lacquers containing up to 70 wt % titanium dioxide have been processed successfully. Thus, the image background yields a high light reflection and makes the images appear more brilliant.

In addition, the lacquers may also contain up to 20 wt % additives, such as uncrosslinkable resins, optical brighteners matting agents, dyes and photoinitiators.

After applying the lacquer to the carrier material, it is crosslinked by means of high energy radiation which may be electron beam radiation or ultraviolet radiation. When using ultraviolet, photoinitiators must be added to the lacquer to form free radicals that initiate the crosslinking reaction.

The lacquers can be applied to the carrier material with the usual applicator systems, such as doctor blade or slit gap metering systems, grid rollers or multiple roll systems.

To produce especially brilliant images, the lacquer is brought in contact with high gloss metal surfaces, e.g. high-gloss cylinders, and crosslinked by exposing it to high energy electron radiation. The radiation treatment with accelerated electrons is applied from the back side, i.e. from the uncoated side of the carrier material. The electrons must be accelerated to the extent that their depth of penetration exceeds the thickness of the carrier material plus the lacquer layer. This technique is described in German Pat. No. 30 22 709.

To improve the flatness or dimensional stability of the carrier material, it may also be coated on both sides with a lacquer or precoated on one or both sides with thermoplastics, such as polyolefins.

A thermoplastic layer that has the function of a barrier layer beneath the intermediate layer of crosslinked lacquers prevents the penetration or absorption of the applied lacquer into the interior of the paper and, thus, saves on the use of lacquer material.

All suitable materials such as those known from the literature can be used for the image receiving layer. The finished image is resistant to aging and heat due to the intermediate layer. However, the coating composition should be free of organic solvents.

In order to assure good adhesion of the image receiving layer on the crosslinked intermediate layer, pretreatments such as corona discharge have proven suitable.

The following examples are presented to illustrate the invention, without restricting it in any way.

Example 1

A paper with a basis weight of 175 g/m$^2$ neutral sized with alkyl ketene dimer was coated on one side with 25±2 g/m$^2$ according to the following lacquer formulations or coating compositions, with a multiroll applicator system at a machine speed of 60 re/min. The paper surface was subjected to a corona pretreatment before coating.

The coated paper was bombarded with accelerated electrons at an energy does of 40 kj/kg coating composition. The coated paper was cured in a scanner installation at a maximum of 180 kV and 100 mA electron current under nitrogen as the inert gas.

The subsequent application of the image receiving layer will be described below.

The cured intermediate layers have the following composition (all values given in wt %):

| | 1a | 1b | 1c |
|---|---|---|---|
| Epoxy acrylate | — | — | 20 |
| Fatty acid modified epoxy acrylate | — | — | 10 |
| Polyester acrylate | — | 60 | — |
| Oligotriacrylate | — | 20 | — |
| Pentaerythritol triacrylate | 10 | — | — |
| Trimethylolpropanetriethoxy triacrylate | 25 | — | 25 |
| Tetraethyleneglycol diacrylate | 10 | — | — |
| Hexanediol diacrylate | — | 20 | 10 |
| Hydroxyethyl acrylate | 15 | — | — |
| Titanium dioxide (rutile) | 40 | — | — |
| Titanium dioxide (anatase) | — | — | 35 |

Wherein the:

Epoxy acrylate is Derakane XD 8008.04 from Dow Chemical, 2 double bonds in the molecule, 6000 Pas viscosity at 25° C.;

Fatty acid modified epoxy acrylate is Derakane XD 9127 from Dow Chemical, 2 double bonds in the molecule, 1900 Pas viscosity at 25° C.;

Polyester acrylate is Ebecryl 810 from UCB-Chemie, 4 double bonds in the molecule, molecular weight ≈1000; and Oligotriacrylate is OTA 480 from UCB-Chemie, 3 double bonds in the molecule molecular, weight ≈480

Example 2

Paper with a basis weight of 135 g/m$^2$ sized with stearic acid, alkyl ketene dimer and epoxidized fatty acid amide was coated on both sides with polyethylene (front side 20 g/m$^2$, back side 25 g/M$^2$) by the melt extrusion process and then, after a corona pretreatment, it was coated on the front side with 20±2 g/m$^2$ according to the following lacquer formulations under the same conditions as in Example 1.

The coated paper was pressed with the coated side against a water cooled high gloss cylinder and bombarded from the back side of the paper with accelerated electrons at an energy dose of 35 Kj/kg coating composition in the same installation and under the same inert gas as in Example 1.

Subsequent application of the image receiving layer is described below.

The cured intermediate layers had the following composition (all amounts given in wt %):

| | 2a | 2b | 2c |
|---|---|---|---|
| Bisphenol A derivative acrylate | 15 | — | — |
| Aliphatic urethane acrylate | — | 50 | — |
| Polyester acrylate | 30 | — | — |
| Pentaerythritol triacrylate | — | 15 | 10 |
| Trimethylolpropane tetraethylene oxide triacrylate | — | 25 | 25 |
| N-vinylpyrrolidone | — | 10 | 10 |
| Acrylated soybean oil | 10 | — | — |
| Allyl glycidyl ether | 5 | — | — |
| Glycerylpropoxy triacrylate | 15 | — | 15 |
| Titanium dioxide rutile | 25 | — | 40 |

Wherein the:

Bisphenol A derivative acrylate is Ebecyrl 150 from UCB Chemie, 2 double bonds in the molecule, 1000 Pas viscosity at 25° C.;

Aliphatic urethane acrylate is Ebecryl 230 from UCB-Chemie, 2 double bonds in the molecule, molecular weight ≈5000;

Polyester acrylate is Ebecryl 810 from UCB-Chemie, 4 double bonds in the molecule, molecular weight % 1000; and Acrylated soybean oil is Synocure 3110 from Cray Valley, 1 double bond/500 equivalent weight.

Comparative Example V1

The raw paper from Example 2 was extrusion-coated with polyethylene on both sides.

The back side was coated with 28 g/m$^2$ of a mixture of:

35 wt % HDPE, g=0.959 g/Cm$^3$, MFI=8
28 wt % HDPE, g=0.950 g/Cm$^3$, MFI=7
20 wt % LDPE, g=0.934 g/Cm$^3$, MFI=3
17 wt % LDPE, g=0.915 g/Cm$^3$, MFI=8

The front side was coated with 22 g/m$^2$ of a mixture of:

42 wt % HDPE, g=0.959 g/Cm$^3$, MFI=8
10 wt % LDPE, g=0.934 g/Cm$^3$, MFI=3
10.3 wt % LDPE, g=0.915 g/Cm$^3$, MFI=8
16.7 wt % LDPE, g=0.924 g/CM$^3$, MFI =4.5
21 wt % titanium dioxide master batch with 50 wt % $TiO_2$.

The subsequent application of the image receiving layer is described below.

Comparative Example V2

The raw paper from Example 1 was coated twice with the formulations from Example lc as Comparative Example V2a and from Example 2 b as a Comparative Example V2b, and where the first layer served as an intermediate layer and the second layer served as an image receiving layer.

The machine conditions correspond to those of Example 1. The application weights were 18-20 g/m$^2$ per layer. Before each coating there was a corona pretreatment.

Comparative Example V3

A Hitachi image receiving material that is available on the market was used for comparison purposes.

Application of the Image Receiving Layer

After a corona pretreatment to form the image receiving layer, the carrier materials with an intermediate layer from Example 1, Example 2 and Comparative Example V1 were coated with the following coating composition from an aqueous solution using a roller applicator:

Formulation

| | |
|---|---|
| Acrylate copolymer (Primal HG 44) 40 wt % aqueous dispersion | 53.8 wt % |
| Oxidized polyethylene (Sudranol 340) 30 wt % aqueous dispersion | 27.6 wt % |
| Silicic acid (Syloid ED50) 15 wt % in water | 11.1 wt % |
| Titanium dioxide (Rutile RN40) 40 wt % in water | 4.1 wt % |
| Fluorine surfactant (FT-248) | 3.4 wt % |

The machine speed was 130 re/min and the drying temperature was 110° C. The weight of the application after drying was 5–7 g/m$^2$.

Test Results

All image receiving materials were subjected to a thermal image transfer process using the Hitachi VY-25E color video printer and Hitachi color tape.

The video printer had the following technical specifications:

| | |
|---|---|
| Image storate: | PAL 1 frame storage |
| Print image: | 64-color image pixels: 540:620 pixels |
| Printing time: | 2 minutes per image |

The color density of each of the individual colors of the resulting images was measured with an SOS-45 original reflection densitometer.

To test the aging resistance and thermal stability a line grid for the individual primary colors was selected and the line widths were measured. since the measurement results for the individual primary colors (cyan, magenta, yellow) differed only slightly but were identical for the most part, the average value for the three primary colors is given in the following table.

As shown by the test results, the image receiving materials (with images) without the crosslinked intermediate layer (Comparative Examples V1 and V3) had a much lower thermal stability and aging resistance than those according to the invention, as expressed in an increase in line width.

Crosslinked intermediate layers combined with crosslinked image receiving layers yielded images with a greatly reduced color density. The lower color density values indicate paler colors.

We claim:

1. An image receiving material for dye diffusion thermal transfer comprising a carrier material, an intermediate layer and an image receiving layer, said intermediate layer comprising a crosslinked material, said image receiving layer consisting essentially of an uncrosslinked material, and wherein both of said layers are formed without the use of organic solvents.

2. The image receiving material of claim 1, wherein said intermediate layer crosslinked material is a crosslinked lacquer that is crosslinked by high energy radiation.

3. The image receiving material of claim 2, wherein said radiation is electron beam or ultraviolet radiation.

4. The image receiving material of claim 1, wherein said intermediate layer is formed from the group consisting of monomers, oligomers, prepolymers or combinations thereof.

5. The image receiving material of claim 1, wherein said intermediate layer is formed in the absence of monomers.

6. The image receiving material of claim 1, wherein said intermediate layer crosslinked material is crosslinked by at least one member selected from the group consisting of a cross-linkable vinyl, allyl, acryl, methacryl or combination thereof.

7. The image receiving material of claim 6, wherein the crosslinkable member comprises in excess of about 50 wt % of at least one ester selected from the group consisting of acrylate and methacrylate esters.

8. The image receiving material of claim 1, wherein said intermediate layer comprises up to about 80 wt % of a white pigment selected from the group consisting of carbonates, oxides, sulfates or sulfites of calcium, magnesium, barium, stronitium, zinc or titanium.

9. The image receiving material of claim 8, wherein said white pigment is titanium dioxide.

10. The image receiving material of claim 1, wherein said intermediate layer also contains at least one addi-

TEST RESULTS

| | Thermal Stability line width, mm | | | | Aging Resistance line width, mm | | | | Color Density | | | |
|---|---|---|---|---|---|---|---|---|---|---|---|---|
| | | 24 Hours at | | | | 60° C. for | | | | | | |
| Example | Immediately | 50° C. | 75° C. | 100° C. | 1 Day | 2 Days | 3 Days | 8 Days | Cyan | Magenta | Yellow | Black |
| Invention | | | | | | | | | | | | |
| 1a | 0.40 | 0.40 | 0.45 | 0.55 | 0.40 | 0.40 | 0.40 | 0.40 | 1.27 | 1.28 | 1.32 | 1.41 |
| 1b | 0.40 | 0.40 | 0.50 | 0.60 | 0.40 | 0.40 | 0.40 | 0.40 | 1.37 | 1.29 | 1.33 | 1.38 |
| 1c | 0.40 | 0.40 | 0.45 | 0.60 | 0.40 | 0.40 | 0.40 | 0.40 | 1.30 | 1.25 | 1.31 | 1.39 |
| 2a | 0.40 | 0.40 | 0.45 | 0.55 | 0.40 | 0.40 | 0.40 | 0.40 | 1.28 | 1.30 | 1.31 | 1.43 |
| 2b | 0.40 | 0.40 | 0.50 | 0.60 | 0.40 | 0.40 | 0.40 | 0.40 | 1.30 | 1.34 | 1.38 | 1.35 |
| 2c | 0.40 | 0.40 | 0.50 | 0.65 | 0.40 | 0.40 | 0.40 | 0.40 | 1.28 | 1.28 | 1.30 | 1.40 |
| Comparison | | | | | | | | | | | | |
| V1 | 0.40 | 0.50 | 1.10 | not measurable | 0.65 | 0.85 | 0.95 | 1.05 | 1.32 | 1.26 | 1.31 | 1.38 |
| V2a | 0.40 | 0.40 | 0.40 | 0.50 | 0.40 | 0.40 | 0.40 | 0.40 | 0.41 | 0.57 | 0.47 | 0.50 |
| V2b | 0.40 | 0.40 | 0.45 | 0.55 | 0.40 | 0.40 | 0.40 | 0.40 | 0.56 | 0.68 | 0.57 | 0.64 |
| V3 | 0.40 | 0.40 | 0.60 | 1.20 | 0.40 | 0.45 | 0.50 | 0.55 | 1.30 | 1.26 | 1.28 | 1.41 |

tive in an amount of less than about 20 wt % and selected from the group consisting of optical brighteners, matting agents, dyes, uncrosslinkable resins and photoinitiators.

11. The image receiving material of claim 1, including a barrier layer between said intermediate layer and said carrier material.

12. The image receiving material of claim 11, wherein said barrier layer comprises a polyolefin.

13. The image receiving material of claim 1, wherein said intermediate layer crosslinked material is a crosslinked lacquer that is crosslinked by high energy radiation; said intermediate layer is formed from the group consisting of monomers, oligomers, prepolymers or combinations thereof; said intermediate layer crosslinked material is crosslinked by at least one member selected from the group consisting of a crosslinkable vinyl, allyl, acryl, methacryl or combinations thereof; and said intermediate layer comprises up to about 80 wt % of a white pigment selected from the group consisting of carbonates, oxides, sulfates or sulfites of calcium, magnesium, barium, strontium, zinc or titanium.

14. The image receiving material of claim 13, including a polyolefin barrier layer between said intermediate layer and said carrier material.

15. An image receiving material for dye diffusion thermal transfer comprising a carrier material, an intermediate layer and an image receiving layer, said intermediate layer comprising a crosslinked material which is crosslinked by at least one member selected from the group consisting of a crosslinkable vinyl, allyl, acryl, methacryl or combination thereof, said image receiving layer comprising a uncrosslinked material, and wherein both of said layers are formed without the use of organic solvents.

16. The image receiving material of claim 15, wherein the crosslinkable member comprises in excess of about 50 wt % of at least one ester selected from the group consisting of acrylate and methacrylate esters.

17. A process for producing an image receiving material for dye diffusion thermal transfer wherein the image receiving material comprises a carrier material, an intermediate layer and an image receiving layer, comprising:

a. subjecting a surface of the carrier material to a corona pretreatment;
b. coating the pretreated surface with a radiation crosslinkable, solvent free lacquer;
c. crosslinking the lacquer with high energy radiation to form the intermediate layer;
d. subjecting the crosslinked intermediate layer to further corona treatment;
e. coating the treated intermediate layer with an aqueous solvent free coating composition; and
f. drying the aqueous coating composition to form the image receiving layer.

18. The process of claim 17, wherein the high energy radiation is electron or ultraviolet radiation.

19. The process of claim 17, wherein said lacquer is monomer free and is applied to the pretreated surface at an elevated temperature.

20. The process of claim 19, wherein said temperature is between about 30°-60° C.

21. The process of claim 17, wherein said high energy radiation is supplied while the lacquer is in contact with a high gloss metal surface.

* * * * *

UNITED STATES PATENT AND TRADEMARK OFFICE

CERTIFICATE OF CORRECTION

PATENT NO. : 5,302,572

DATED : April 12, 1994

INVENTOR(S) : Reiner Anthonsen, Wieland Sack, Dieter Becker, Jurgen Graumann and Manuela Hesse It is certified that error appears in the above-indentified patent and that said Letters Patent is hereby corrected as shown below:

On the cover page under Assignees, "AG" should read --KG--.
Col. 1, line 23, "this" should read --the--.
Col. 2, line 19, "300°C" should read --30°C--.
Col. 3, line 19, "re/min" should read --m/min--; line 23, "kj/kg" should read --kJ/kg--; line 55, "molecule molecular, weight" should read --molecule, molecular weight--; line 61, "g/$M^2$" should read --g/$m^2$--.
Col. 4, line 31, delete "%" and insert --≈--; line 60, "Example 2 b as a Comparative" should read --Example 2b as Comparative--.
Col. 5, line 24, "re/min" should read --m/min--; line 46, "since" should read --Since--.

Signed and Sealed this

Thirtieth Day of May, 1995

Bruce Lehman

*Attest:*

BRUCE LEHMAN

*Attesting Officer*

*Commissioner of Patents and Trademarks*